United States Patent [19]

Kennard, Jr. et al.

[11] Patent Number: 5,016,768

[45] Date of Patent: May 21, 1991

[54] PICKUP TRUCK DERRICK WITH TRAVELING SHEAVES

[75] Inventors: Dwight C. Kennard, Jr., 3830 Incochee Trail, Traverse City, Mich. 49684; James C. Kennard, P.O. Box 76, Maple City, Mich. 49664; Carl J. Wick, Gladstone, Mich.

[73] Assignees: David C. Kennard, Jr., Traverse City; James C. Kennard, Maple City, both of Mich.

[21] Appl. No.: 430,884

[22] Filed: Nov. 2, 1989

[51] Int. Cl.[5] ..... B66C 23/82

[52] U.S. Cl. ..... 212/262; 212/183

[58] Field of Search ..... 212/182, 183, 185, 196, 212/250, 260, 262; 52/116, 117, 120

[56] References Cited

U.S. PATENT DOCUMENTS

| | | | |
|---|---|---|---|
| 81,317 | 8/1868 | Williams | 212/189 |
| 142,740 | 9/1873 | Serrell | 212/196 |
| 2,259,966 | 10/1941 | Tappe . | |
| 2,335,584 | 11/1943 | Couse | 52/117 |
| 2,364,851 | 12/1944 | Johansen . | |
| 2,444,835 | 7/1948 | Le Tourneau | 212/262 |
| 2,583,958 | 1/1952 | Moon . | |
| 2,804,979 | 9/1957 | Lassiter | 212/262 |
| 3,084,806 | 4/1963 | Staples . | |
| 3,129,821 | 4/1964 | Graham et al. | 212/250 |
| 3,253,716 | 5/1966 | Stratton . | |
| 3,285,445 | 6/1966 | Broziat . | |
| 3,433,459 | 3/1969 | Logan | 212/262 |
| 3,870,162 | 3/1975 | Nakajo . | |
| 4,068,762 | 1/1978 | Kennard, Jr. et al. . | |
| 4,615,450 | 10/1986 | Kennard, Jr. et al. . | |
| 4,623,067 | 11/1986 | Hejlik . | |
| 4,651,884 | 3/1987 | Kennard Jr. et al. . | |
| 4,700,851 | 3/1987 | Reeve et al. . | |

FOREIGN PATENT DOCUMENTS

| | | | |
|---|---|---|---|
| 680659 | 5/1930 | France | 212/262 |
| 1038429 | 9/1953 | France | 212/196 |
| 480502 | 2/1938 | United Kingdom | 212/182 |

OTHER PUBLICATIONS

Super-Master catalog sheet by Air Technical Industries.

*Primary Examiner*—Sherman Basinger
*Assistant Examiner*—Thomas J. Brahan
*Attorney, Agent, or Firm*—Price, Heneveld, Cooper, DeWitt & Litton

[57] ABSTRACT

A portable derrick assembly adapted for mounting on a pickup truck or a trailer, includes a base frame, a derrick tower, a tower erection subassembly, and an elongated boom pivotally mounted on the tower. A traveling sheave and cable subassembly interconnects a tail end of the boom with the tower for pivoting the boom about a pitch axis. A hoist cable is raised and lowered by a hoist traveling sheave subassembly mounted on the boom.

45 Claims, 13 Drawing Sheets

PICKUP TRUCK DERRICK WITH TRAVELING SHEAVES

BACKGROUND OF THE INVENTION

The present invention relates to material handling apparatus, and more particularly to a portable utility crane or derrick mountable on a pickup truck or on a trailer.

In many industries a need exists for a temporary or portable hoist which can be transported to a work site, quickly and easily erected and which may be easily operated. In the construction industry, for example, portable cranes are used to lift materials, and to install air conditioning systems, roof antennas, signs, trusses, and the like. In the majority of these operations, large cranes are not needed. The load carrying capacity of a large self propelled derrick or crane vehicles greatly exceeds the loads which would be encountered in the general contracting industry.

In order to fulfill these needs, various portable crane or derrick assemblies have been proposed. Many of the prior systems have suffered from undue complexity and lack of versatility. U.S. Pat. No. 3,797,672 to Vermette entitled APPARATUS ATTACHABLE TO A TRUCK BODY OR THE LIKE FOR USE FOR HOISTING OR LIFTING, OR AS AN ELEVATED SUPPORT, issued May 19, 1974, discloses a device having a frame attachable to stake holes of a pickup truck. The device supports a single, vertically extending boom. Attached to the top of the boom is crossmember to which a cable hoist is secured. The boom is collapsible to permit transportation of the apparatus.

Many of the problems, heretofore, experienced are addressed in the commonly owned prior patents of the present inventors, including U.S. Pat. No. 4,068,762 entitled PICKUP TRUCK DERRICK, issued on Jan. 17, 1978; U.S. Pat. No. 4,615,450 entitled PORTABLE AND COLLAPSIBLE DERRICK STRUCTURE, which issued on Oct. 7, 1986, and U.S. Pat. No. 4,651,884 entitled PORTABLE AND COLLAPSIBLE DERRICK STRUCTURE, which issued on Mar. 24, 1987. The '762 patent discloses an improved, portable hoist or derrick assembly which includes a rectangular base frame securable to the side rails of a conventional pickup truck. A collapsible A-frame is pivotally mounted on the base frame. Provision is made for supporting the A-frame and for erecting the A-frame to a vertical position. A foldable, two-piece boom assembly is pivotally and swingably carried on an A-frame support plate. Provision is made for erecting the boom from a folded stored position, for elevating the boom during hoisting operations and for swinging the boom about a vertical axis. The '450 and '884 patents disclose various improvements in the derrick structure of the '762 patent. As disclosed therein, provision is made for elevating the A-frame and locking the frame in an operating position. Different forms of frame erection subassembies including an elongated track, roller and carriage arrangement are disclosed. In another form, the erection subassembly includes lead screw actuators, combined with support braces.

SUMMARY OF THE INVENTION

In accordance with the present invention, an improved, portable derrick or crane assembly is provided which possesses reduced complexity, increased versatility, and improved reliability from those heretofore available. Essentially, the assembly includes a base frame, a derrick tower, and a boom mounted on the tower. Provision is made for raising the tower from a collapsed transport position to an operating position. A simplified traveling sheave and cable subassembly interconnects the boom and the tower to raise and lower the boom about a pitch axis. A hoist means, also including a traveling sheave subassembly, raises and lowers a hoist cable.

DETAILED DESCRIPTION OF THE PREFERRED EMBODIMENT

Figure 1:
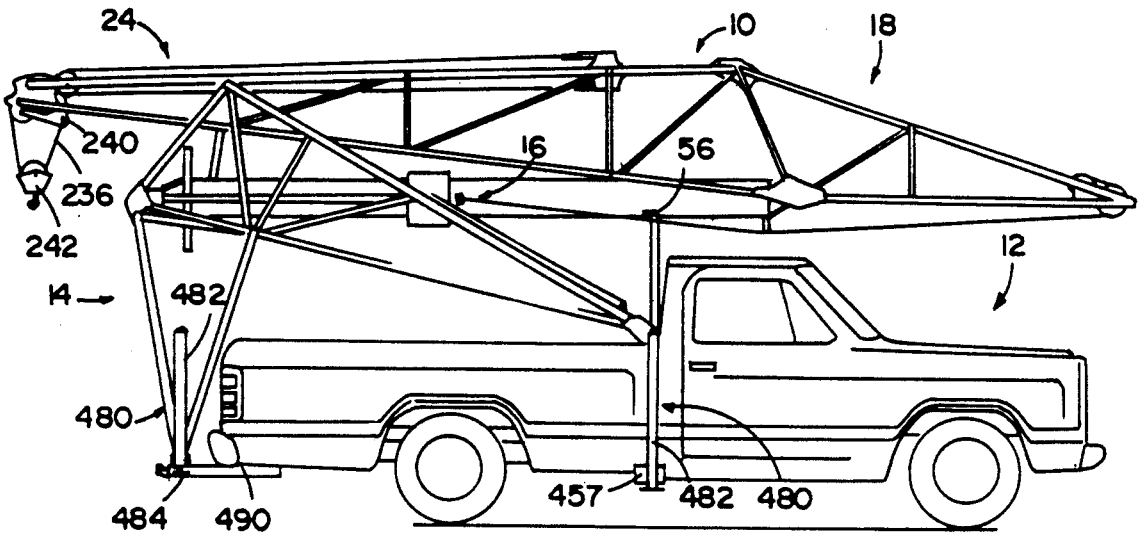
FIG. 1 is a side elevational view of a portable derrick or crane in accordance with the present invention mounted on a pickup truck in its collapsed or transport position.
Figure 2:
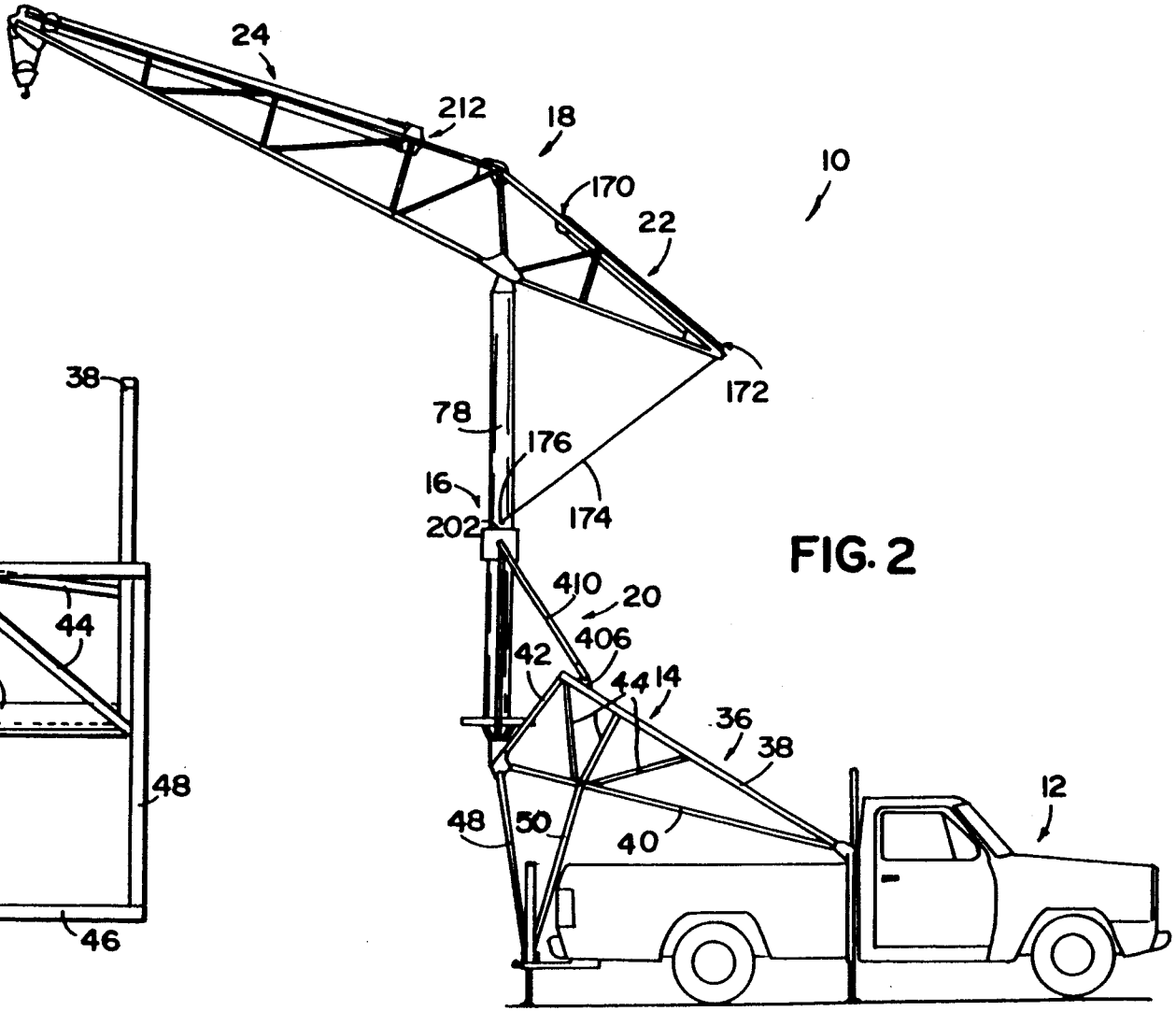
FIG. 2 is a side elevational view of the crane of FIG. 1 in its elevated or operating position.

A collapsible and portable derrick or crane in accordance with the present invention, is illustrated in FIGS. 1 and 2 and generally designated by the numeral 10. Crane 10 is shown mounted on a pickup truck 12. Crane 10 includes a base or mainframe subassembly 14, an erectable tower subassembly 16 and a boom 18. Boom 18 is mounted for pivotal movement about a horizontal or pitch axis on the top of tower 16. Crane 10 further includes a tower erection subassembly 20, a tail end traveling sheave and cable subassembly 22, and a hoist cable subassembly 24.

Figure 4:
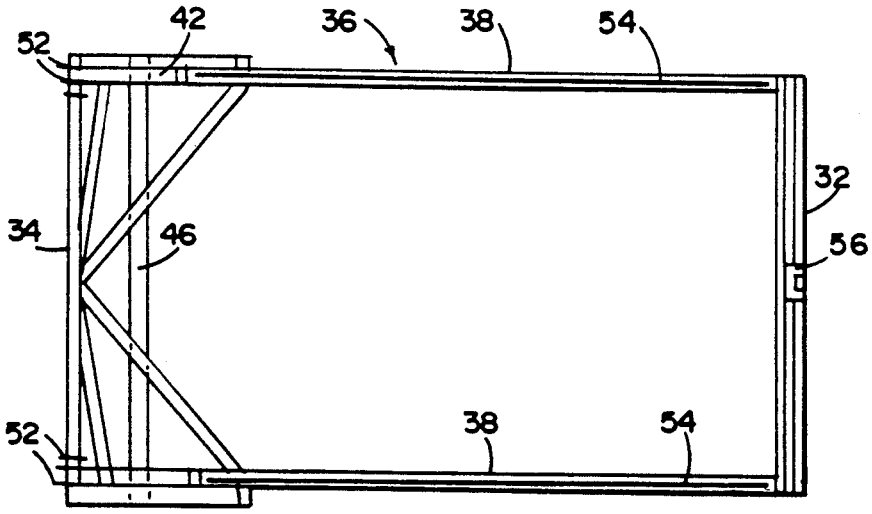
FIG. 4 is a top, plan view thereof.
Figure 3:
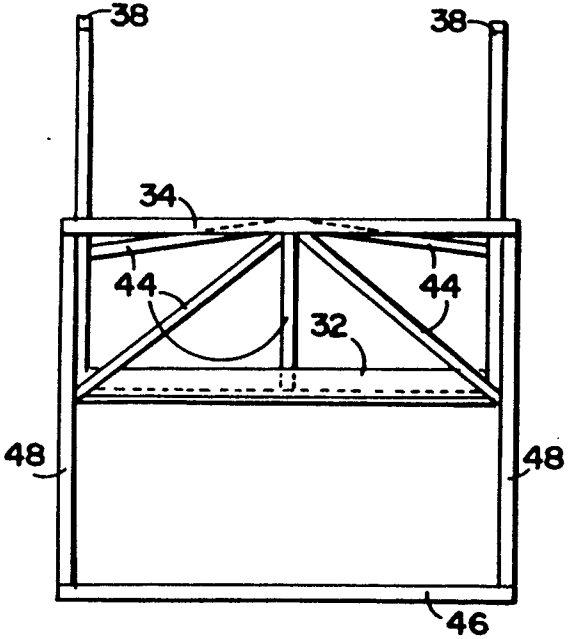
FIG. 3 is a front, elevational view of a base frame incorporated in the present invention.

Base frame 14 as seen in FIGS. 2, 3 and 4, includes a crossmember 32, a front crossmember 34, and side trusses 36. Side trusses 36 each include an upper rail 38, a lower rail 40, and trussing members 42, 44. Side trusses 36 and crossmember 34 are connected to a lower crossmember 46 by legs 48, 50. As shown in FIG. 4, each end of crossmember 34 is provided with a pair of pivot mounting plates 52. As explained in more detail below, tower subassembly 16 is pivoted to crossmember 34 at plates 52.

Each of the upper tracks or struts 38 of trusses 36 is generally rectangular in configuration and defines an elongated slot 54. Tracks 38 form a portion of the tower erection subassembly, described in more detail below. In addition, crossmember 32 includes a plate 56 upon which tower 16 rests when it is in its lowered or collapsed position as shown in FIG. 1.

Tower subassembly 16 is best seen in FIGS. 2, 5, 6, and 7. As shown therein, the tower includes a triangular frame 62 having side members 64 joined to lower or base members 66. Pivot mounting plates 68 are welded to ends of base members 66. Plates 68 define apertures 70. The plates are dimensioned to be positioned within the pivot plates 52 on crossmember 34 of the base frame. Suitable pivot pins secure frame 62 and hence the tower subassembly to the base frame. Upper ends of side members 64 of frame 62 are secured to a generally cylindrical collar 72. A bearing and mounting plate subassembly 74 is mounted on frame 62 by trussing members 76. An elongated tower member 78 is rotatably mounted on the bearing subassembly 74 and encircled by collar 72. As a result, tower member 78 is mounted on frame 62 for rotational or yawing movement about a vertical or longitudinal axis of member 78.

Figure 6:
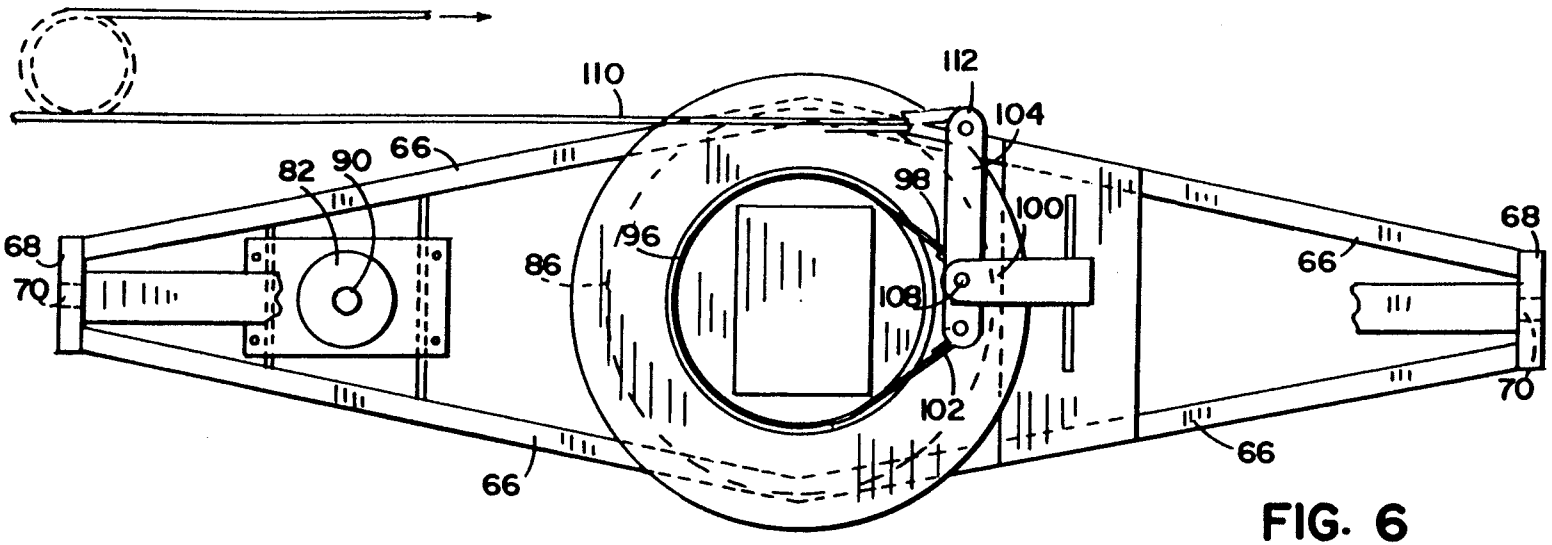
FIG. 6 is an enlarged, fragmentary, top plan view of a portion of the tower subassembly of FIG. 5.
Figure 7:
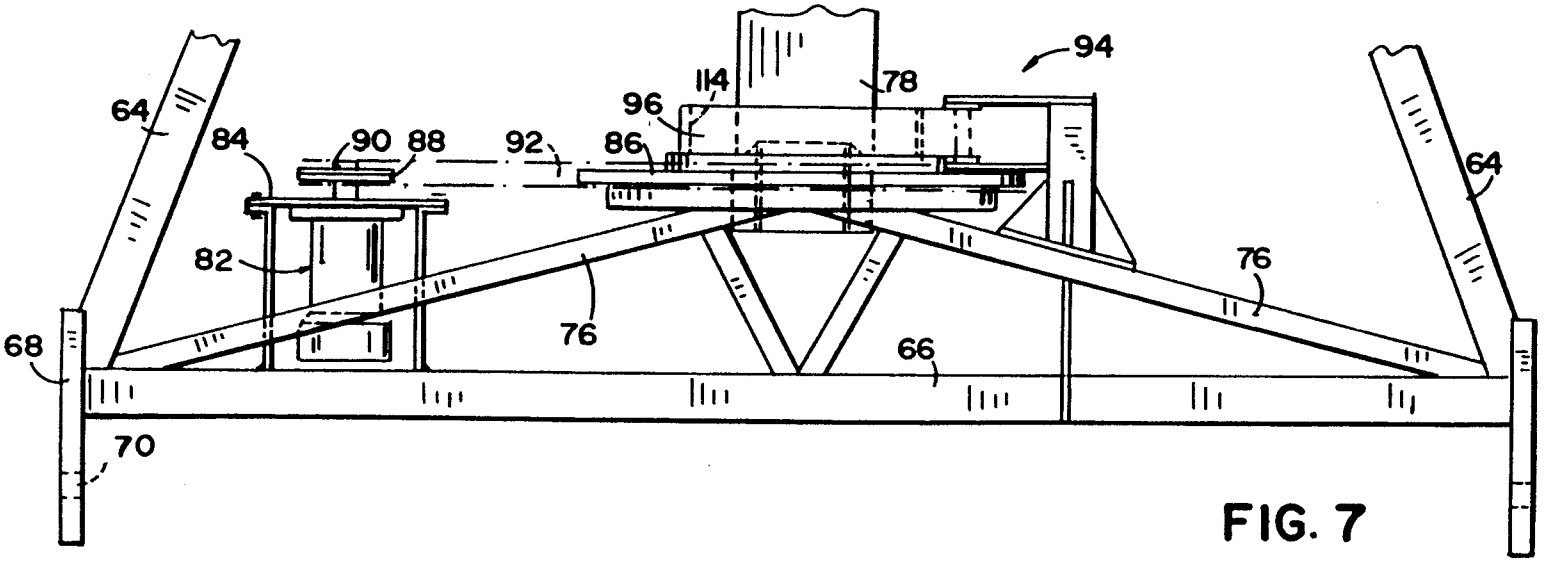
FIG. 7 is an enlarged, fragmentary, front elevational view of the tower subassembly.
Figure 11:
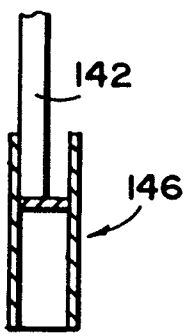
FIG. 11 is a cross-sectional view taken generally along line XI—XI of FIG. 8.
Figure 10:
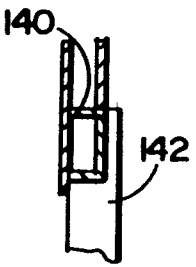
FIG. 10 is a cross-sectional view taken generally along line X—X of FIG. 8.
Figure 9:
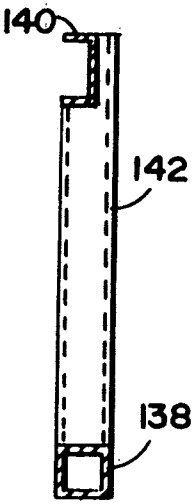
FIG. 9 is a cross-sectional view taken generally along line IX—IX of FIG. 8.

As best seen in FIGS. 6 and 7, rotational movement of tower member 78 is achieved by a drive motor 82 secured to a mounting plate 84, supported on base 66. A driven sprocket 86 is secured to tower member 78. A drive sprocket 88 fixed to an output shaft 90 of motor 82 is connected to driven sprocket 86 by a roller chain 92. Motor 82 may be any suitable electric or hydraulic motor. In addition, a band brake subassembly 94 is provided for stopping rotation of tower 78. In the form illustrated, brake 94 includes a band 96 fixed at one end 98, to a bracket 100. An opposite end 102 is fixed to a brake lever 104. Lever 104 is pivoted to bracket 106 at a pivot point 108. A cable 110 is connected to an end 112 of lever 104. Pulling on cable 110 will tighten band 96 against a cylindrical brake surface 114 secured to sprocket 86. In the alternative, a disc brake including a conventional caliper and rotor could be substituted for the band brake illustrated.

Figure 5:
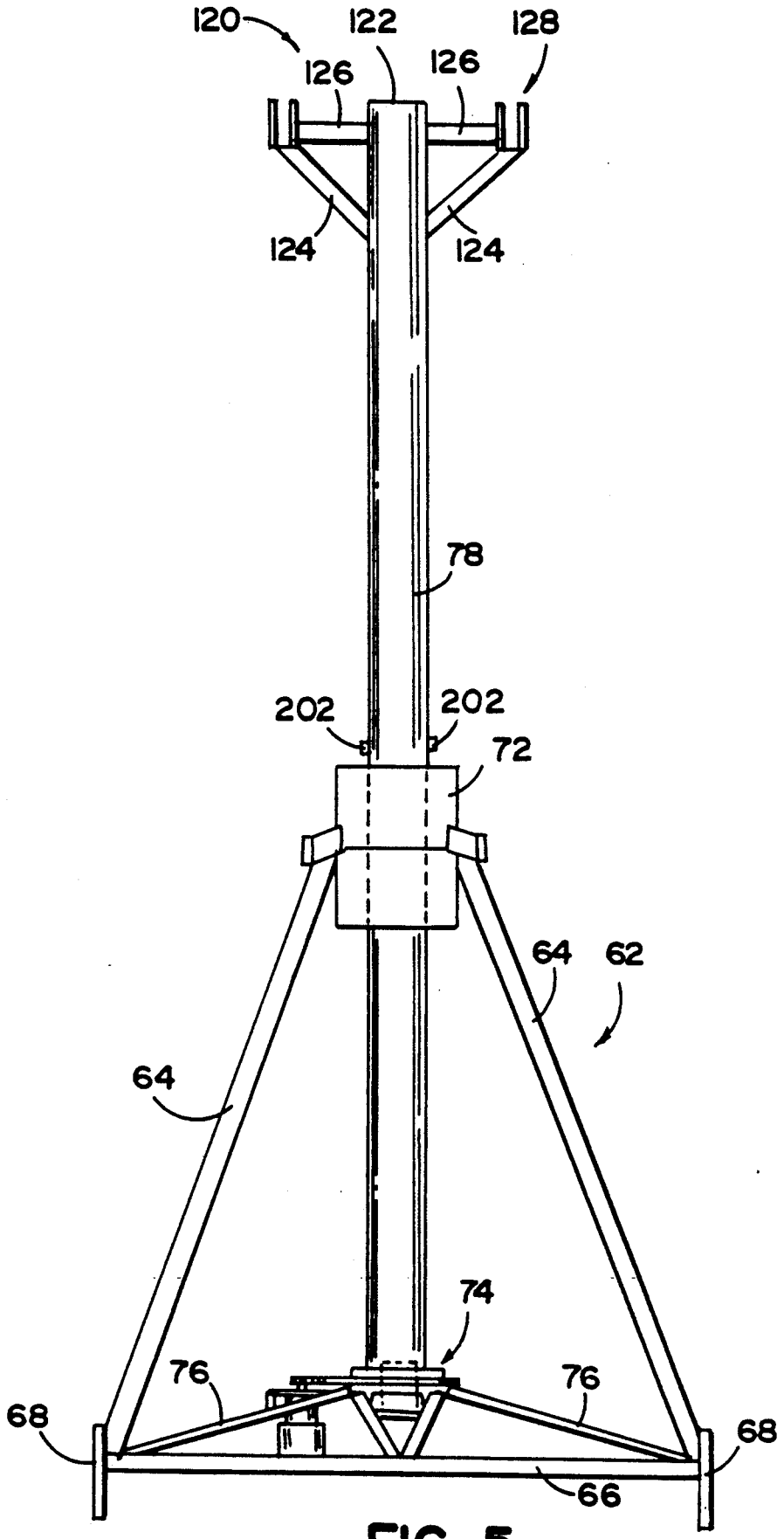
FIG. 5 is an elevational view of a tower subassembly incorporated in the present invention.

As seen in FIG. 5, a boom pivot structure 120 is secured to an upper end 122 of tower member 78. Pivot structure 120 includes member 124 and 126. Pivot mounting plates 128 are secured to the joined ends of members 124, 126.

Boom 18 is illustrated in FIGS. 8–11. The boom includes a tail end 132 and a hoist cable end 134. Boom 18 further includes a pair of spaced, parallel side truss members 136 extending between hoist end 134 and tail end 132. Side truss members include lower tubes 138 and upper channel or guide track members 140. The members are connected by suitable trussing members or reinforcement stringers 142. A pivot plate structure 146 is secured to tubes 138 and reinforcement tubes or stringers 142. As best seen in FIG. 2, boom 18 is pivotally mounted to upper end 122 of tower member 78. Plate structure 146 is secured to the pivot plates 128 on tower 78. As a result, boom 18 will pivot about a horizontal or pitch axis on tower subassembly 16.

Figure 8:
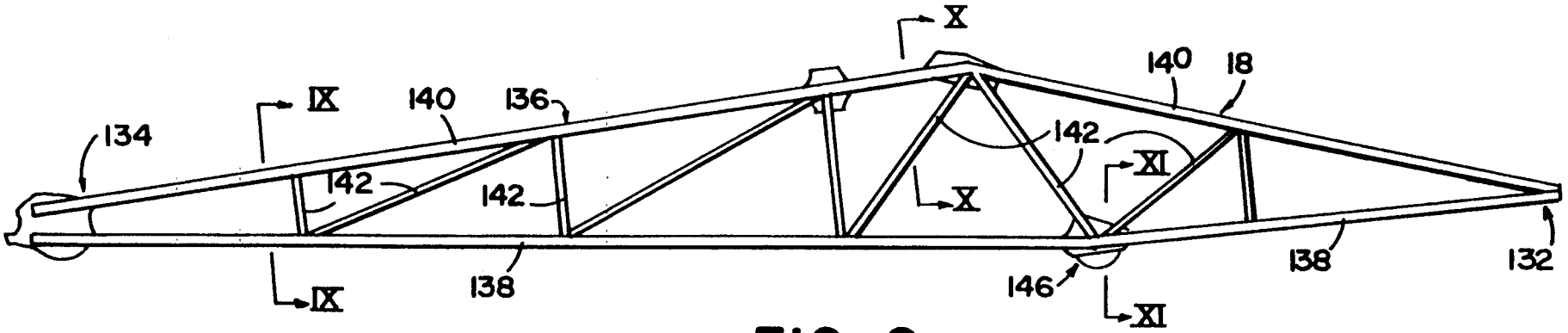
FIG. 8 is a side elevational view of a boom incorporated in the present invention.
Figure 8A:
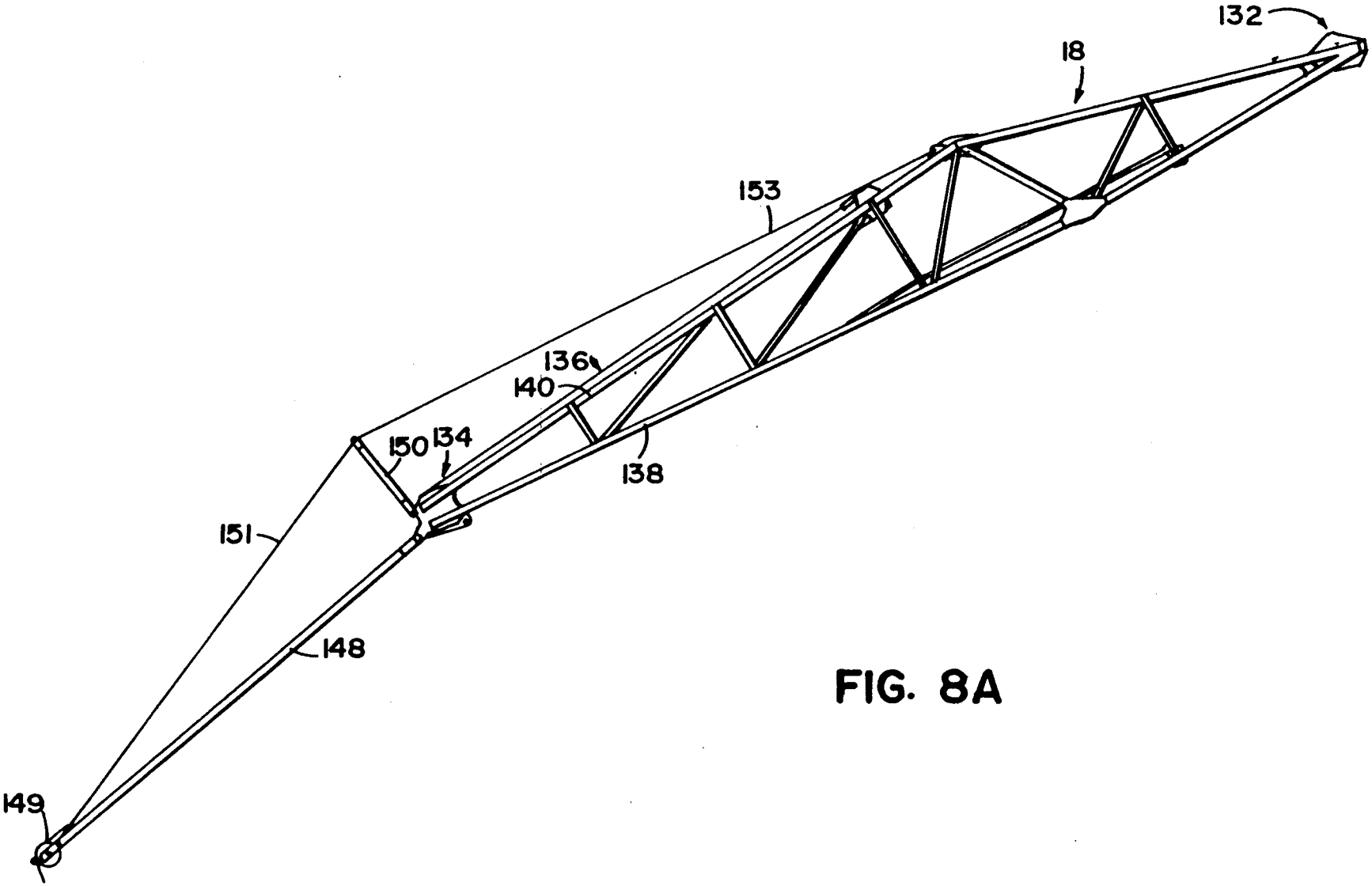
FIG. 8*a* is a side elevational view of the boom of FIG. 8 including an extension or jib.

As shown in FIG. 8*a*, an extension or jib 148 supporting a hoist cable pulley 149 may be attached to hoist cable end 134. Jib 148 is further supported by a strut 150 and cable grips 151, 153.

Figure 12:
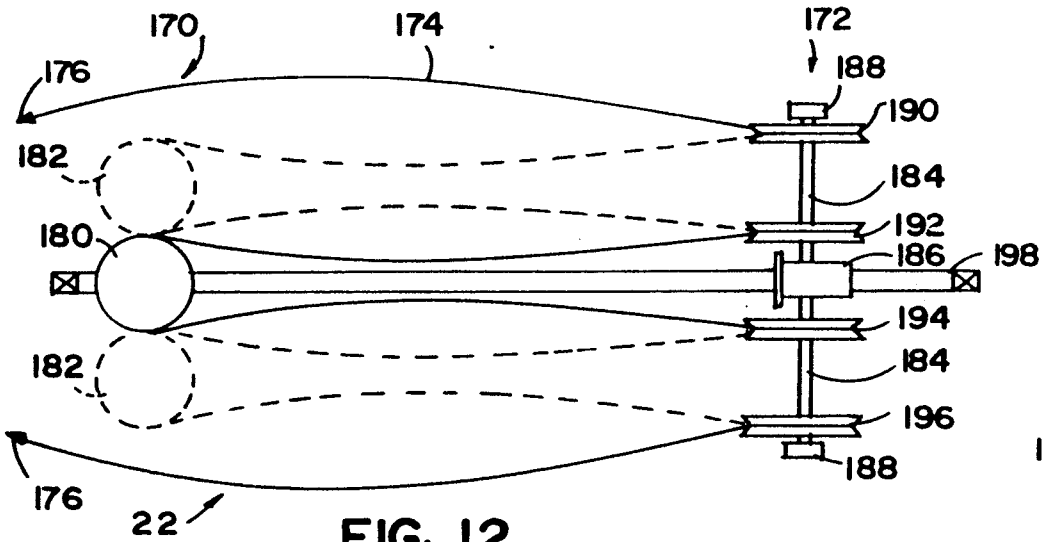
FIG. 12 is a schematic, plan view of a tail traveling sheave and cable subassembly in accordance with the present invention.

Subassembly 22 is provided for pitching boom 18 about its pitch axis or raising and lowering tail end 132 with respect to tower subassembly 16. As seen in FIGS. 2 and 12, subassembly 22 includes a fixed sheave arrangement 70, a traveling sheave arrangement 172 and a cable 174 having cable ends 176. As schematically shown in FIG. 12, the fixed sheave assembly 170 includes an upper, horizontally positioned fixed sheave or cable pulley 180 and a pair of lower, horizontal, fixed sheave or pulleys 182. Sheaves 182 are indicated by dotted lines as being in a lower plane from the plane containing sheave 180. Traveling sheave assembly 172 includes an axle 184 which is secured to a follower or lead screw nut 186. Rollers 188 are mounted on the ends of axle 184. The rollers ride in tracks defined by boom members 140. A plurality of rotatable sheaves or pulleys 190, 192, 194, and 196 are mounted on axle 184. A lead screw 198 engages follower 186 to shift assembly 172 longitudinally along boom 18. Ends 176 of cable 174 are secured to attachment points 202 on tower member 76. Cable 174 extends from one end 176 over sheave 190 to a first lower sheave 182. Sheave 182 is positioned in a plane which intersects or which contains the bottom tangents of sheaves 190, 192, 194, and 196. Cable 174 then extends to sheave 192 up and around fixed sheave 180. Fixed sheave 180 lies in a horizontal plane which contains the upper tangents of sheaves 190–196. The cable then continues around sheave 194 to lower fixed sheave 182. The cable is then reaved around sheave 196 to its point of fixation with tower 76. When traveling sheave subassembly 172 is moved to the right by screw 198 when viewed in FIG. 12, cable 174 is reeled in and the boom is pitched up. When the nut moves to the left, the cables are reeled out and the boom is pitched down.

Cable 174 is reaved as an integral length. As a result, should the cable break anywhere along its length, it will freely pass through all sheaves and let the boom fall in its plane of pitching rotation. The boom will not be pulled to one side or the other. If the two tail ends of the cable were mechanically independent, a break on one side would cause the other side to produce an asymmetrical restraint. The boom could flip unexpectedly out of its normal plane of pitching rotation.

The traveling sheave and cable subassembly is, in affect, a modified block and tackle device working in reverse with respect to traditional applications. The "output cables" or tail ends 176 move by a factor N in relation to the traveling sheave subassembly 172, where N is the number of effective cable lines between the traveling and fixed sheave assemblies. The output cable pull is 1/N times the load on the traveling sheave nut assembly 172. As shown in FIG. 12, fixed sheave 180 is a point of cable fixity. Sheave 180 does not rotate during normal movement of sheave assembly 172. Sheave 180 will rotate only to compensate for geometric irregularities in the system. As a result, the effective number of cable lines is four (4) and the pull on each end cable is ¼ times the reaction force on each sheave pair 190, 192, and 194, 196. The motion at each end of cable 176 is four times that of the traveling sheave subassembly 172.

The cable runs are parallel to each other in the span between the traveling sheaves and the fixed sheaves. The geometric relationship is achieved by configuring the system so that the sheave diameters D are the same as the space in between sheave centers. As set forth above, sheave 180 is in a top plane which contains the top tangents of sheaves 190–196. The lower sheaves 182 lie on a bottom plane which contains the bottom tangents of sheaves 190–196. The top and bottom planes are separated by a distance equal to the sheave diameter D.

Figure 14:
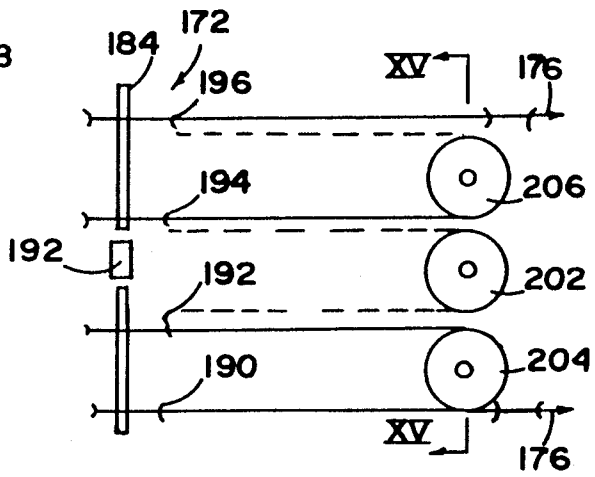
FIG. 14 is a schematic view of an alternative sheave and cable subassembly.
Figure 15:
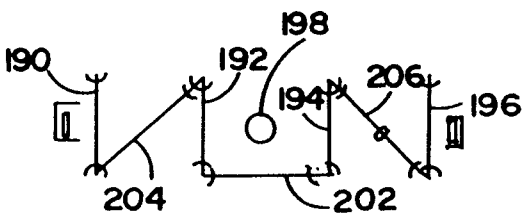
FIG. 15 is a cross-sectional view taken generally along line XV—XV of FIG. 14.

FIGS. 14 and 15 schematically illustrate an alternative sheave arrangement. The alternative structure includes a traveling sheave subassembly 172 having sheaves 190–196. In the modified form, a central fixed sheave 202 lies in a lower plane which contains the lower tangents of sheaves 190–196 (FIG. 15). Fixed sheaves 204, 206 are positioned or slanted at a 45 degree angle. Sheave 204 is slanted between a lower tangent of sheave 190 and an upper tangent of sheave 192. Sheave 206 is slanted between a lower tangent of sheave 196 and an upper tangent of sheave 194. In the embodiment of FIGS. 14 and 15, lower sheave 202 corresponds to sheave 180 of the embodiment of FIG. 12. Sheave 202 is in effect fixed and does not rotate. It defines a fixed point on cable 174. Sheave 202 may, of course, rotate slightly to compensate for irregularities in system geometry or in tracking of the moving sheave assembly 172.

Figure 13:
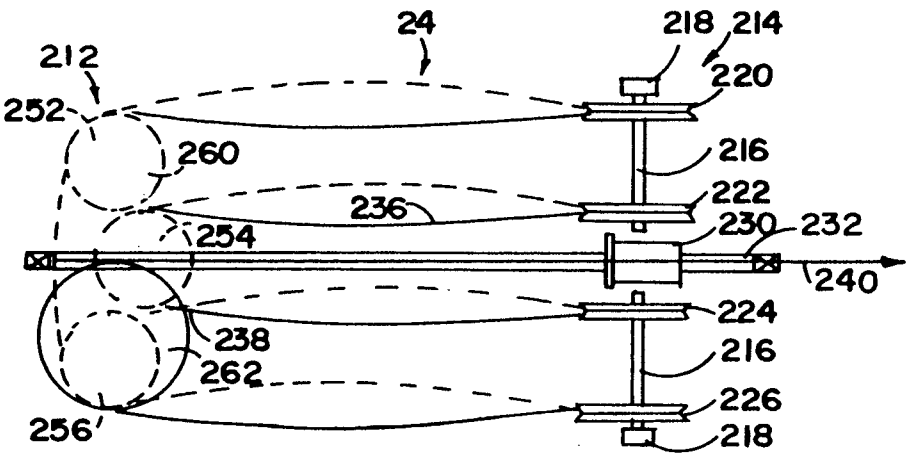
FIG. 13 is a schematic, plan view of a traveling sheave and hoist cable subassembly in accordance with the present invention.

Hoist cable subassembly 24 is illustrated in FIGS. 2 and 13. Subassembly 24 includes a fixed sheave assembly 212 and a traveling sheave assembly 214. Traveling sheave assembly 214 includes an axle 216 supporting rollers 218. Rollers 218 ride in the guide tracks defined by the boom structure. Traveling sheave subassembly 214 includes sheaves 220, 222 and 224, 226. Axle 216 is secured to a follower or nut 230 which is driven by a lead screw 232. The hoist system includes a single cable 236. Cable 236 has an end 238 fixed to the boom. A hoist end 240 exits along the longitudinal center line of the boom. As illustrated in FIGS. 1 and 2, end 240 may be fixed to a suitable bracket on the boom. A hoist hook 242 is positioned on cable 236.

Fixed sheave subassembly 212 includes three lower sheaves 252, 254, and 256. Assembly 212 also includes two upper sheaves 260 and 262. Sheaves 260, 262 lie in a horizontal plane which contains the upper tangents of vertically oriented sheaves 220–226. Sheaves 252, 254, and 256 lie in a lower horizontal plane which contains the lower tangents of sheaves 220–226. As schematically shown in FIG. 13, cable 236 extends from fixed end 238 over sheave 240 and around lower sheave 254 to sheave 222. The cable then extends around upper fixed sheave 260 to movable sheave 220. The cable moves from sheave 220 to lower fixed sheave 252 and across lower fixed sheave 256. After exiting sheave 256, the cable passes around sheave 222 and then around the larger upper sheave 262. The cable exits from sheave 262 along the longitudinal center line of the boom and the lead screw 232. The sheaves have a diameter D except for sheaves 262 which has a diameter of 3D/2. As a result, the cable leaves the system on the boom center line.

Figure 23:
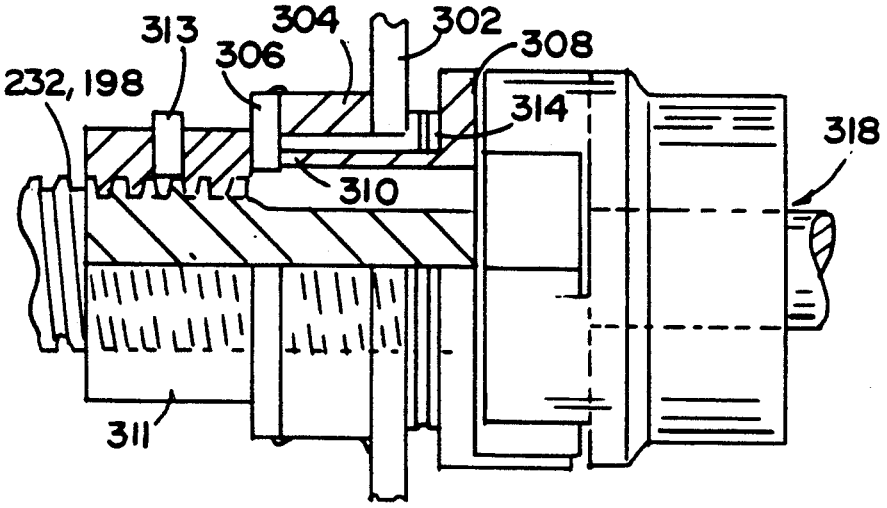
FIG. 23 is a fragmentary, partially sectioned view of the driven end of the lead screw drive incorporated in the tail boom and hoist, subassemblies.
Figure 24:
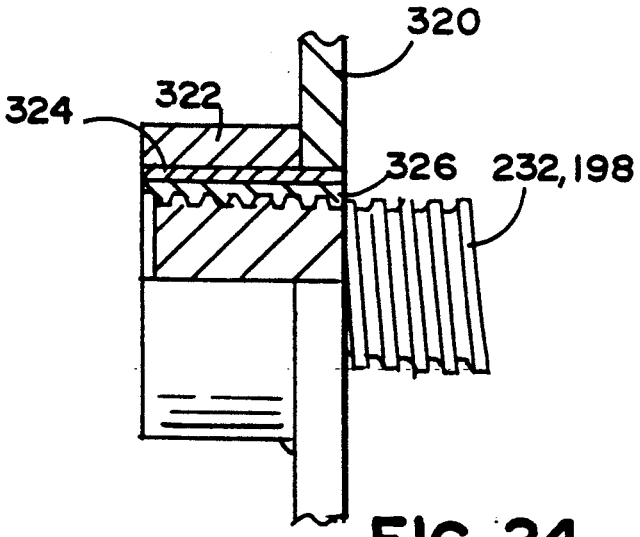
FIG. 24 is a fragmentary, partially sectioned view of the non-driven end of the lead screw drive of FIG. 23.

Details of the lead screw drive for the tail end and the hoist subassemblies are illustrated in FIGS. 23 and 24. FIG. 23 illustrates the driven end of screw 232 or screw 198. The screw is secured to a mounting plate 302. The fitting includes a boss 304 and a washer 306 welded thereto. A nut 308 extends within boss 304 and is keyed to the lead screw. Positioned between nut 308 and boss 304 is a radial sleeve bearing 310. A thrust bearing 314 is positioned between a flange 312 of nut 308 and the mounting plate. The lead screw is connected to a suitable drive motor through a coupling 318.

The nondriven end of the lead or power screw is supported on a suitable mounting plate 320 (FIG. 24). Welded to mounting plate 320 is a generally cylindrical boss 322. Positioned within the boss is a radial bushing 324 and a threaded bushing 326 is keyed to the threaded shaft. The fittings, therefore, support the shaft for rotational movement. Rotation of the shaft causes translation of the traveling nuts.

Figure 16:
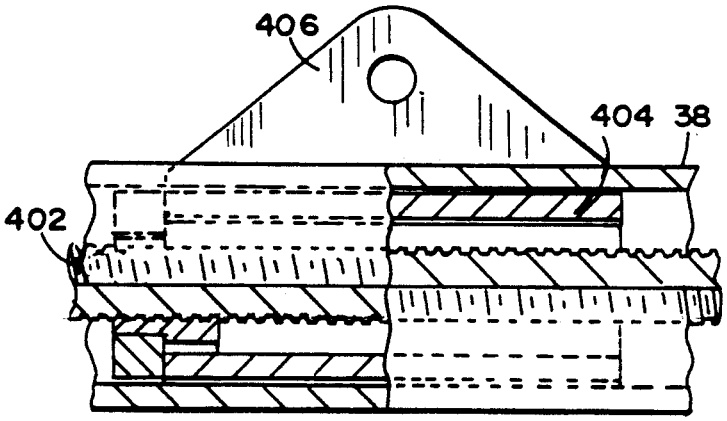
FIG. 16 is a fragmentary, side elevational view in partial cross-section of a portion of a lead screw drive incorporated in a tower erection subassembly in accordance with the present invention.
Figure 16A:
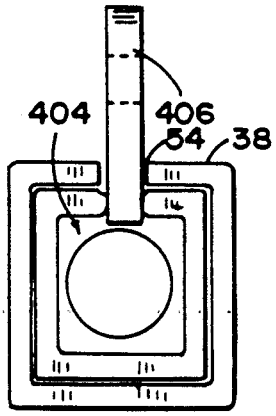
FIG. 16*a* is a cross-sectional view of the lead screw drive of FIG. 16.

The tower erection system is illustrated in FIGS. 16–22. Tower subassembly 16 is erected by driving two screws in synchronism. The screws are housed in the square track tubes 38 of the base frame 36. As shown in FIGS. 16 and 16A, tubes 38 define an elongated, upper slot 54. Supported within tube 38 is a lead or power screw 402. An internally threaded nut or slider assembly 404 is moved longitudinally by rotation of power screw 402. Nut 404, as clearly shown in FIG. 16A, slides on the inner surfaces of tube 38. A fin, tab or weldment 406 is welded to nut 404. The nuts or sliders 404 and weldments 406 are connected to tower member 76 by side struts or links 410 (FIG. 2). The drive for the lead screws includes an elongated mounting plate 420 which extends between the right and left guide tracks 38.

Figure 17:
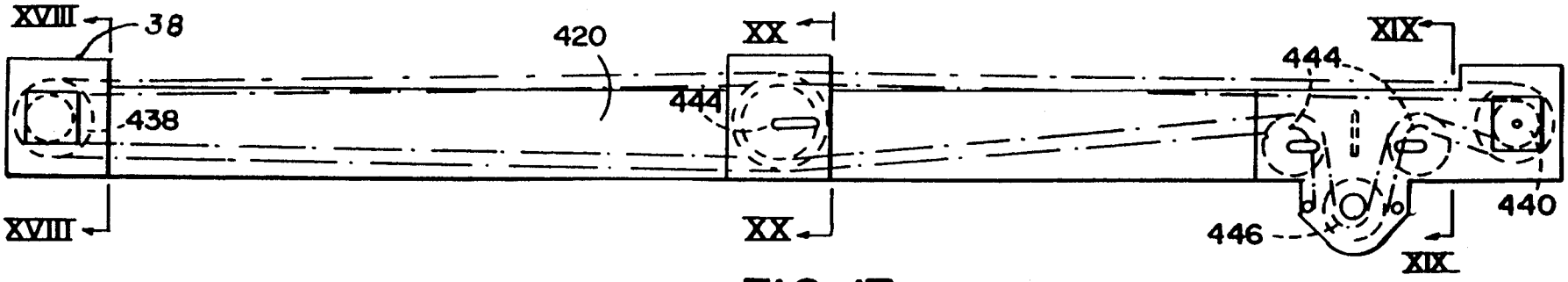
FIG. 17 is an end, elevational view of the lead screw drive subassembly.
Figure 21:
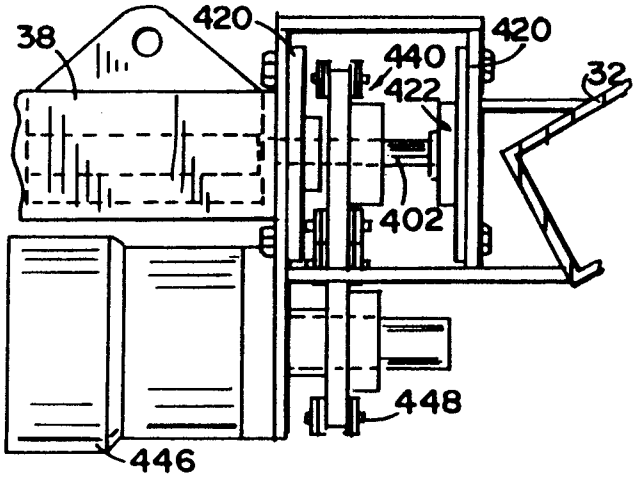
FIG. 21 is a fragmentary, right hand, side elevational view of the tower erection system of FIG. 17.
Figure 18:
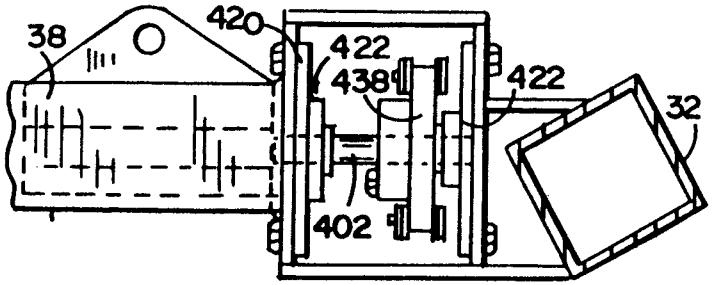
FIG. 18 is a cross-sectional view taken generally along XVIII—XVIII of FIG. 17.
Figure 20:
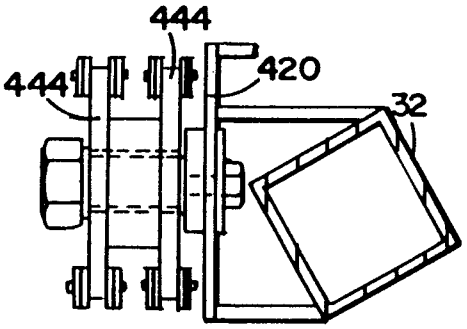
FIG. 20 is a cross-sectional view taken generally along XX—XX of FIG. 17.
Figure 19:
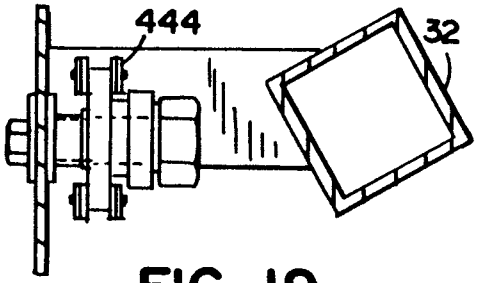
FIG. 19 is a partial cross-sectional view taken generally along XIX—XIX of FIG. 17.
Figure 22:
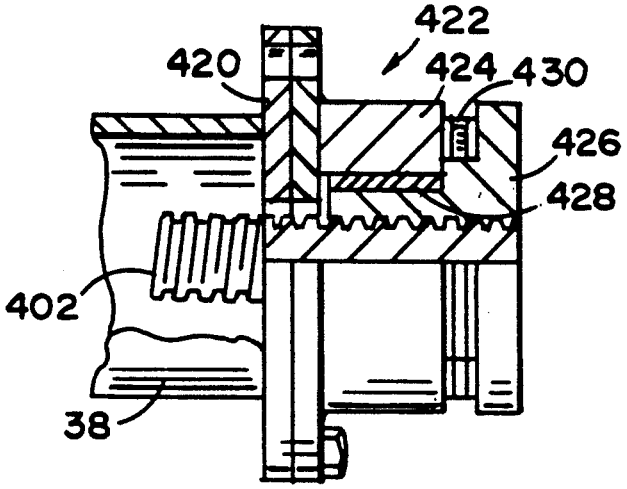
FIG. 22 is a fragmentary, partially sectioned view of a end bearing for the tower erection screws.

As shown in FIG. 22, lead screws 402 are rotatably mounted on plate 420 by an end bearing subassembly 422. Bearing subassembly 422 includes a cylindrical boss 424 supporting a special nut 426. Positioned between nut 426 and boss 424 is a radial bushing 428 and a thrust bushing 430. A sprocket 438 is nonrotatably secured to the left hand lead screw 402. Another sprocket 440 is secured to the right hand lead screw (FIGS. 17 & 21). A plurality of idler sprockets 444 are rotatably mounted on plates 420 and crossmember 32. A drive motor 446 is mounted on plates 420 adjacent the right hand side of the crossmember. As shown, a roller chain connects a drive sprocket 448 with sprockets 440, 438. The roller chain extends around the driven sprockets and the idler sprockets 444. Motor 446, therefore, simultaneously drives lead screws 402 to move the sliders along tubes 38 to thereby raise and lower the tower subassembly.

Figure 28:
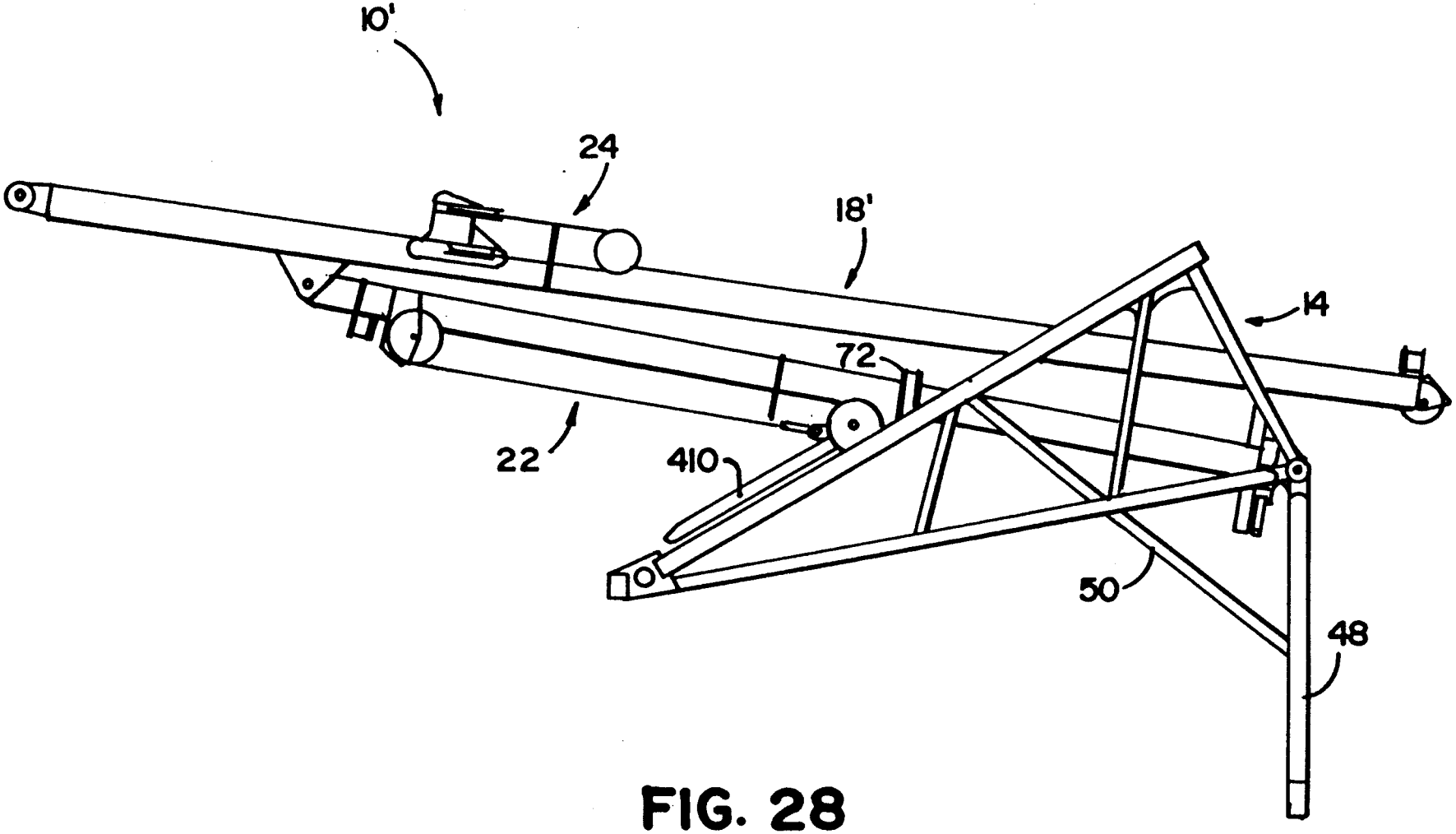
FIG. 28 is a side elevational view of a crane in accordance with the present invention including an alternative tubular boom and shown in the transport position.
Figure 29:
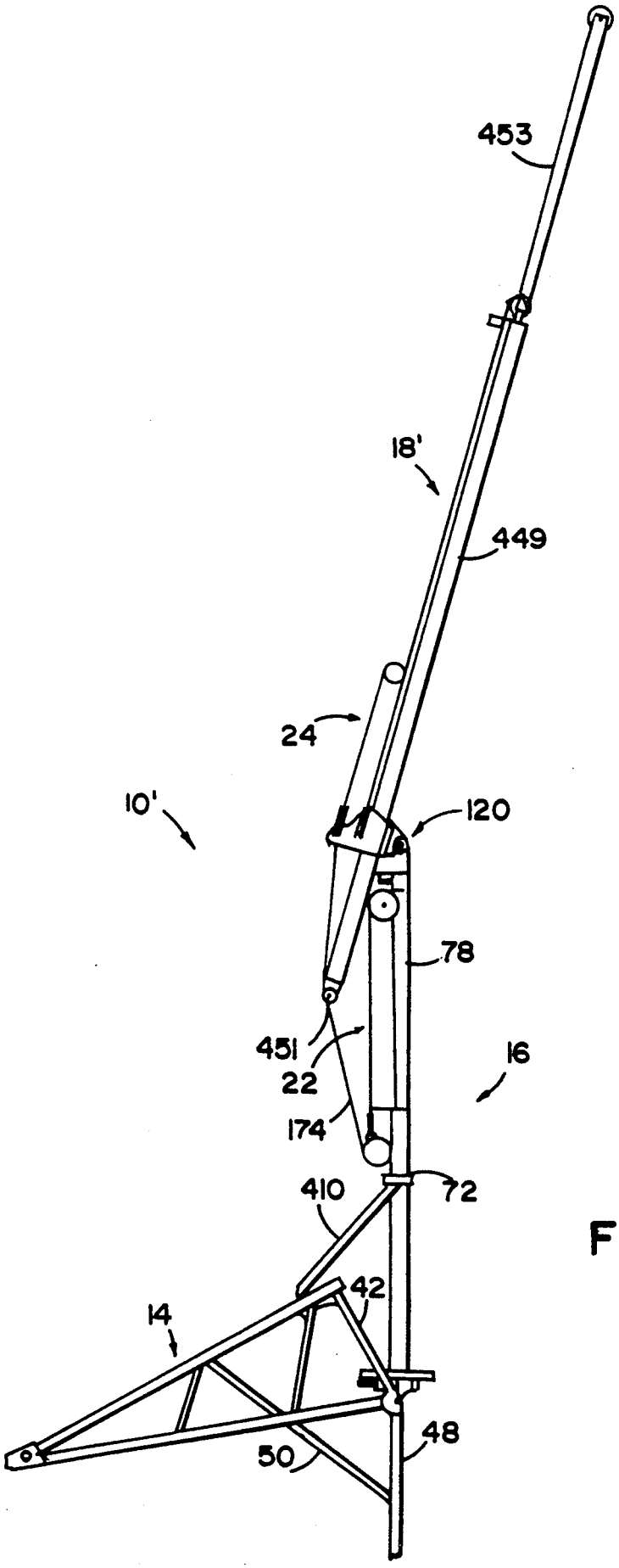
FIG. 29 is a side elevational view o f t he crane of FIG. 28 in its operating position.

A crane 10' including an alternative boom 18' is illustrated in FIGS. 28 and 29. Boom 18 includes a single, elongated, straight, structural tubular member 449. Member 449 is pivoted to tower member 78 at pivot structure 120. Subassembly 22 is mounted on tower 78 between pivot structure 120 and collar 72. Cable 174 is attached to an end 451 of boom member 449 Subassembly 24 is mounted on boom member 449. As seen in FIG. 29, a boom extension or jib 453 may be telescoped into boom member 449. When the extension is desired, the jib may be manually positioned on member 449 and fixed with a suitable pin or the like.

Figure 25:
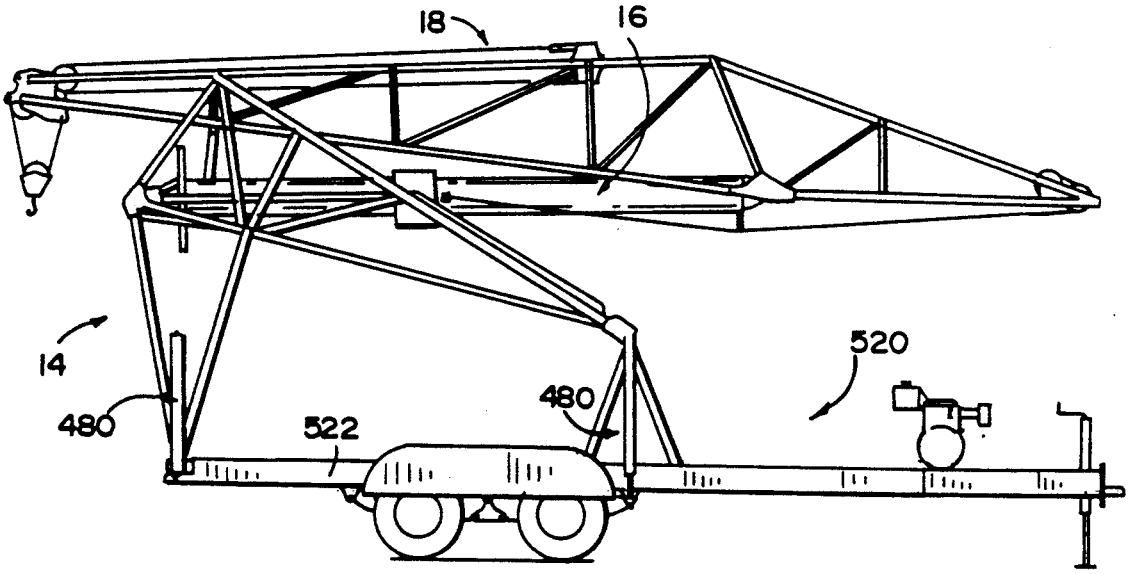
FIG. 25 is a side, elevational view of the portable crane mounted on a trailer.

As shown in FIGS. 1, 2, and 25, base or mainframe 14 supports stabilizer subassemblies 480. At least four assemblies 480 are positioned at the corners of base 14. Each of the stabilizers 480 includes a tube 482 and an extendable foot 484.

The base or mainframe subassembly 14 when in the travel configuration of FIG. 1, is supported at the rear by brackets 490 attached to the mainframe of the truck. At the front, the main frame is attached to and supported by a cross member 457. Member 457 extends transversely of the truck frame and is attached thereto. The base 14 is, therefor, rigidly secured to the truck frame. In addition, fittings at the front stake pockets of the truck secure the front end of the base from side-to-side and fore-and-aft movements and/or loads. Such fittings do not restrain vertical loads or movements significantly. The attachment of base 14 to the truck frame defines rigid connections which restrain both vertical and downward motions between the truck frame and base 14. Tilting action produced by the crane with the boom extended to the side will cause the non-load side of the truck to tend to raise while pivoting around the stabilizer feet on the load side.

In use, the stabilizers 480 would be extended so that the weight of the crane and truck is in effect supported on the feet 484 of the stabilizers. The crane may then be erected through activation of the lead screws of the tower erection system to position the crane from the travel position shown on FIG. 1 to the upright operating position shown in FIG. 2. In preparing the crane for travel, the tower is again folded down. The front stabilizers 480 adjacent the truck bed are retracted. The load of the crane at the rear is supported by brackets 490 secured to the truck frame and at the front by cross member 457 also secured to the truck frame. The stabilizers or feet 484 are retracted or slid back in to their outer members. Suitable fittings are secured to the truck frame adjacent the forward stabilizers 480 to provide for carrying the crane weight. The crane is then ready for travel.

FIG. 25 illustrates a configuration wherein the crane is mounted on a trailer 520. Trailer 520 includes a bed 522. Base frame 14 rests on the bed 522 and is secured thereto. Stabilizers 480 may be extended for crane operation. The crane may be mounted on either a pickup truck or on a trailer. No modification to the crane structure per se is necessary.

Figure 26:
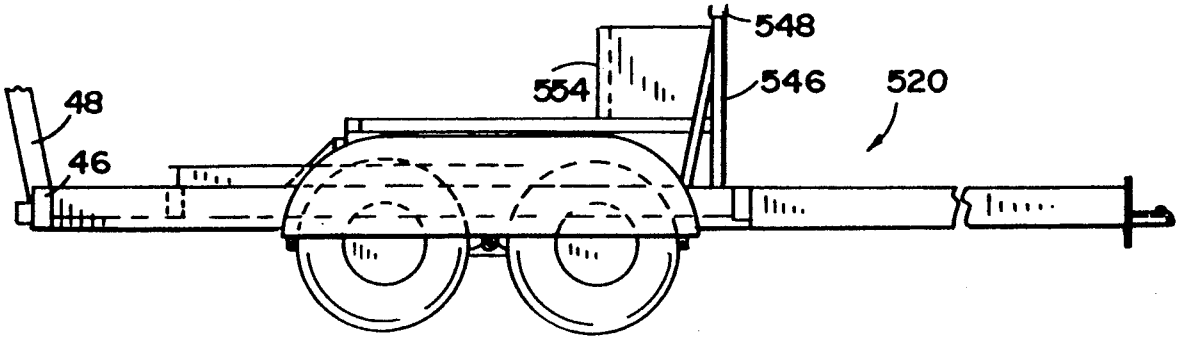
FIG. 26 is a side, elevational view of the trailer for the collapsible derrick in accordance with the present invention.
Figure 27:
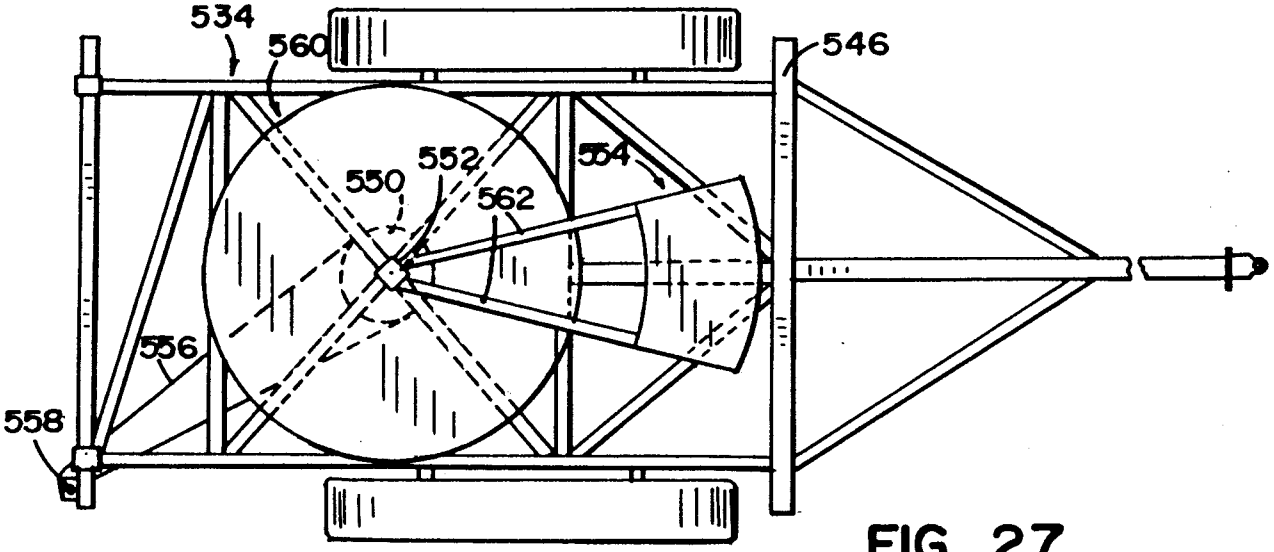
FIG. 27 is a top, plan view of the trailer of FIG. 26.

Trailer 520 as shown in FIGS. 26 and 27 may be provided with a rotating counterbalance. As shown, trailer 520 includes a suitable frame structure 534. A forward frame portion 546 includes an upwardly open channel 548. Base frame 14 is positioned on trailer 520 with crossmember 32 disposed within channel 548. A sprocket 550 is rotatably mounted on frame structure 534. A shaft 552 is secured to the sprocket. A counterbalance weight 554 is mounted on arms 562 to extend outwardly from shaft 552. Arms 562 rest on a circular track 560 which surrounds shaft 552. Shaft 552 and hence counterbalance weight 554, are rotated by a chain drive 556. Chain 556 extends around sprocket 550 and a second sprocket 558. Sprocket 558 is suitably connected to a drive motor or to the drive sprocket for the tower rotation system. Rotation of the tower, therefore, will rotate the counterbalance weight.

As should now be appreciated, the crane or portable derrick in accordance with the present invention provides increased versatility and reliability with reduced complexity from that heretofore available. The traveling sheave and cable arrangements for the pitch control and for hoist cable control have inherent advantages over the prior winch arrangements. Increased load capacities and ease of operation are achieved. The lead screw or power screw drive arrangements for the tower erection system, the pitch or tail end traveling sheave and hoist cable sheave arrangements efficiently operate the crane. The crane may be easily transported on a conventional pickup truck or on a trailer. The base frame is configured so that the bed of the pickup truck or of the trailer remain open for use. The crane is easily placed in its collapsed transportation position. The crane may be erected and used by a single operator.

In view of the foregoing description those of ordinary skill in the art may envision various modifications which would not depart from the inventive concepts disclosed herein. The above should, therefore, be considered as only that of the preferred embodiment. The true spirit and scope of the present invention may be determined by reference to the appended claims.

The embodiments of the invention in which an exclusive property or privilege is claimed are defined as follows:

1. A collapsible derrick assembly adapted for mounting on a pickup truck or a trailer, said assembly comprising:

a base frame;

a derrick tower having a base pivotal to said base frame;

tower erection means connected to said tower for moving said tower from a collapsed position to an erected position;

an elongated boom pivotally mounted on said tower for movement about a pitch axis, said boom defining a longitudinal axis;

tail traveling sheave and cable means interconnecting a tail end of said boom and said tower for raising and lowering said tail end to cause said boom to move about said pitch axis, said tail traveling sheave and cable means including a traveling sheave assembly, a fixed sheave assembly mounted on said boom, a lead screw drive on said boom and engaging said traveling sheave assembly for moving said traveling sheave assembly towards and away from said fixed sheave assembly along the longitudinal axis of said boom and a cable reaved around said sheave assemblies and connected to said tower;

a hoist cable on said boom; and hoist means connected to said hoist cable for raising and lowering said hoist cable.

2. A collapsible derrick assembly as defined by claim 1 further including tower rotation means for rotating said tower around a yaw axis.

3. An assembly as defined by claim 1 wherein said tower comprises:

a tower frame;

a bearing mounted on said tower frame;

an elongated member fixed to said bearing at a lower end thereof; and a boom pivot fixed to said member at an upper end thereof.

4. An assembly as defined by claim 3 wherein said tower further comprises:

a collar on said tower frame, said collar including a cylindrical portion encircling said elongated member intermediate the ends of said elongated member.

5. An assembly as defined by claim 4 further including brake means engaging said tower for stopping rotation of said tower.

6. An assembly as defined by claim 1 wherein said hoist means comprises:

a traveling hoist sheave assembly including a plurality of traveling hoist sheaves;

hoist drive means on said boom and engaging said hoist sheave assembly for moving said assembly along said boom; and a plurality of fixed hoist sheaves secured to said boom, said hoist cable being reaved around said hoist sheaves and having and end fixed to said boom.

7. An assembly as defined by claim 6 wherein said traveling hoist sheaves are positioned in spaced, parallel, vertical planes.

8. A collapsible derrick assembly adapted for mounting on a pickup truck or a trailer, said assembly comprising:

a base frame;

a derrick tower having a base pivotal to said base frame;

tower erection means connected to said tower for moving said tower from a collapsed position to an erected position;

an elongated boom pivotally mounted on said tower for movement about a pitch axis;

tail traveling sheave and cable means interconnecting a tail end of said boom and said tower for raising and lowering said tail end to cause said boom to move about said pitch axis;

a hoist cable on said boom; and hoist means connected to said hoist cable for raising and lowering said hoist cable, and wherein said tail traveling sheave and cable means comprises:

a traveling sheave assembly including a plurality of traveling sheaves and mounting means for mounting and traveling sheaves for longitudinal movement on said boom;

a fixed sheave assembly including a plurality of fixed sheaves mounted on said boom;

a cable having a pair of ends secured to said tower, said cable being reaved over said sheaves; and drive means on said boom for moving said traveling sheave assembly towards and away from said fixed sheave assembly so that said boom moves about said pitch axis.

9. An assembly as defined by claim 8 wherein said traveling sheave assembly includes four sheaves positioned in spaced, parallel relationship with each shave lying in a vertical plane.

10. An assembly as defined by claim 9 wherein said fixed sheave assembly includes three fixed sheaves, one of said fixed sheaves lying in an upper, horizontal plane which plane intersects top tangents of said traveling sheaves.

11. An assembly as defined by claim 10 wherein two of said fixed sheaves of said fixed sheave assembly lie in lower planes which extend below said upper, horizontal plane.

12. An assembly as defined by claim 11 wherein said lower planes are coextensive and extend in spaced, parallel relationship to said upper horizontal plane.

13. An assembly as defined by claim 8 wherein said fixed sheave assembly includes a lower fixed sheave which lies in a lower, horizontal plane which intersects lower tangents of said traveling sheaves.

14. An assembly as defined by claim 13 wherein said fixed sheave assembly further includes a pair of angled, fixed sheaves each lying in an oppositely angled plane which intersect the plane of said lower fixed sheave.

15. An assembly as defined by claim 13 wherein said hoist means comprises:

a traveling hoist sheave assembly including a plurality of hoist sheaves;

hoist drive means on said boom and engaging said hoist sheave assembly for moving said assembly along said boom; and a plurality of fixed hoist sheaves secured to said boom, said hoist cable being reaved around said hoist sheaves and having and end fixed to said boom.

16. An assembly as defined by claim 15 wherein said hoist sheaves are positioned in spaced, parallel, vertical planes.

17. An assembly as defined in by claim 16 wherein a plurality of said fixed hoist sheaves lie in a fixed plane perpendicular to the planes of said traveling hoist sheaves and said fixed plane intersects the lower tangents of said traveling hoist sheaves.

18. An assembly as defined by claim 8 wherein said fixed sheave assembly includes a lower fixed sheave which lies in a lower, horizontal plane which intersects lower tangents of said traveling sheaves.

19. An assembly as defined by claim 18 wherein said fixed sheave assembly includes a pair of angled, fixed sheaves each lying in an oppositely angled plane which intersect the plane of said lower fixed sheave.

20. An assembly as defined by claim 19 wherein said drive means comprises:

an elongated lead screw rotatably mounted on said boom;

a nut on said screw, said nut being connected to said traveling sheave assembly; and motor means connected to said lead screw for rotating said screw.

21. An assembly as defined by claim 20 wherein said tower erection means comprises:

a pair of spaced, tubular tracks;

a pair of drive screws, each screw rotatably mounted within one of said tracks;

a pair of links, each link having an end pivoted to said tower and another end pivoted to one of said nuts; and screw drive means connected to said drive screws for rotating said screws.

22. An assembly as defined by claim 8 wherein said drive means comprises:

an elongated lead screw rotatably mounted on said boom;

a nut on said screw, said nut being connected to said traveling sheave assembly; and motor means connected to said lead screw for rotating said screw.

23. A collapsible derrick assembly adapted for mounting on a pickup truck or a trailer, said assembly comprising:

a base frame;

a derrick tower having a base pivotal to said base frame;

tower erection means connected to said tower for moving said tower from a collapsed position to an erected position;

an elongated boom pivotally mounted on said tower for movement about a pitch axis;

tail traveling sheave and cable means interconnecting a tail end of said boom and said tower for raising and lowering said tail end to cause said boom to move about said pitch axis;

a hoist cable on said boom; and hoist means connected to said hoist cable for raising and lowering said hoist cable, and wherein said tower comprises:

a tower frame;

a bearing mounted on said tower frame;

an elongated member fixed to said bearing at a lower end thereof;

a boom pivot fixed to said member at an upper end thereof; and a collar on said tower frame, said collar including a cylindrical portion encircling said elongated member intermediate the ends of said elongated member, and wherein said tail traveling sheave and cable means comprises:

a traveling sheave assembly including a plurality of sheaves and mounting means for mounting said sheaves for longitudinal movement on said boom;

a fixed sheave assembly including a plurality of fixed sheaves mounted on said boom;

a cable having a pair of ends secured to said tower, said cable being reaved over said sheaves; and drive means on said boom for moving said traveling sheave assembly towards and away from said fixed sheave assembly so that said boom moves about said pitch axis.

24. An assembly as defined by claim 23 wherein said traveling sheave assembly includes four sheaves positioned in spaced, parallel relationship with each sheave lying in a vertical plane.

25. An assembly as defined by claim 23 wherein said fixed sheave assembly includes three fixed sheaves, one of said fixed sheaves lying in an upper, horizontal plane which plane intersects top tangents of said traveling sheaves.

26. An assembly as defined by claim 25 wherein two of said fixed sheaves of said fixed sheave assembly lie in lower planes which extend below said upper, horizontal plane.

27. An assembly as defined by claim 26 wherein said lower planes are coextensive and extend in spaced, parallel relationship to said upper horizontal plane.

28. An assembly as defined by claim 27 wherein said drive means comprises:

an elongated lead screw rotatably mounted on said boom;

a nut on said screw, said nut being connected to said traveling sheave assembly; and motor means connected to said lead screw for rotating said screw.

29. An assembly as defined by claim 28 wherein said tower erection means comprises:

a pair of spaced, tubular tracks;

a pair of drive screws, each screw rotatably mounted within one of said tracks;

a pair of links, each link having an end pivoted to said tower and another end pivoted to one of said nuts; and screw drive means connected to said drive screws for rotating said screws.

30. A collapsible derrick assembly adapted for mounting on a pickup truck or a trailer, said assembly comprising:

a base frame;

a derrick tower having a base pivotal to said base frame;

tower erection means connected to said tower for moving said tower from a collapsed position to an erected position;

an elongated boom pivotally mounted on said tower for movement about a pitch axis;

tail traveling sheave and cable means interconnecting a tail end of said boom and said tower for raising and lowering said tail end to cause said boom to move about said pitch axis;

a hoist cable on said boom;

hoist means connected to said hoist cable for raising and lowering said hoist cable, and wherein said tower erection means comprises:

a pair of spaced, tubular tracks;

a pair of drive screws, each screw rotatably mounted within one of said tracks;

a pair of links, each link having an end pivoted to said tower and another end pivoted to one of said nuts; and screw drive means connected to said drive screws for rotating said screws.

31. A collapsible derrick assembly adapted for mounting on a pickup truck or a trailer, said assembly comprising:

a base frame;

a derrick tower having a base pivotal to said base frame;

tower erection means connected to said tower for moving said tower from a collapsed position to an erected position;

an elongated boom pivotally mounted on said tower for movement about a pitch axis;

tail traveling sheave and cable means interconnecting a tail end of said boom and said tower for raising and lowering said tail end to cause said boom to move about said pitch axis;

a hoist cable on said boom;

hoist means connected to said hoist cable for raising and lowering said hoist cable, said tower comprising:

a tower frame;

a bearing mounted on said tower frame;

an elongated member fixed to said bearing at a lower end thereof;

a boom pivot fixed to said member at an upper end thereof; and a collar on said tower frame said collar including a cylindrical portion encircling said elongated member intermediate the ends of said elongated member, and wherein said tower erection means comprises:

a pair of spaced, tubular tracks;

a pair of drive screws, each screw rotatably mounted within one of said tracks;

a pair of links, each link having an end pivoted to said tower and another end pivoted to one of said nuts; and screw drive means connected to said drive screws for rotating said screws.

32. A collapsible derrick assembly adapted for mounting on a pickup truck or a trailer, said assembly comprising:

a base frame;

a derrick tower having a base pivotal to said base frame;

tower erection means connected to said tower for moving said tower from a collapsed position to an erected position;

an elongated boom pivotally mounted on said tower for movement about a pitch axis;

tail traveling sheave and cable means interconnecting a tail end of said boom and said tower for raising and lowering said tail end to cause said boom to move about said pitch axis;

a hoist cable on said boom; and hoist means connected to said hoist cable for raising and lowering said hoist cable, said hoist means comprising:

a traveling hoist sheave assembly including a plurality of hoist sheaves;

hoist drive means on said boom and engaging said hoist sheave assembly for moving said assembly along said boom; and a plurality of fixed hoist sheaves secured to said boom, said hoist cable being reaved around said hoist sheaves and having and end fixed to said boom, said hoist sheaves of said traveling hoist sheave assembly being positioned in spaced, parallel, vertical planes, and wherein a plurality of said fixed hoist sheaves lie in a fixed plane perpendicular to the planes of said traveling hoist sheaves and said fixed plane intersects the lower tangents of said traveling hoist sheaves.

33. An assembly as defined by claim 32 wherein one of said fixed hoist sheaves lies in an upper plane perpendicular to the planes of said traveling hoist sheaves and which upper plane intersects the upper tangents of said traveling hoist sheaves.

34. A crane comprising:

a derrick;

an elongated boom;

pivot means on said device for pivotally mounting said boom to said derrick for movement about a pitch axis;

a traveling sheave assembly on said boom, said assembly including a plurality of traveling sheaves and drive means for moving said sheaves along a longitudinal axis of said boom;

a fixed sheave assembly including a plurality of fixed sheaves mounted on said boom;

a pitch cable having a pair of ends attached to said derrick, said cable being reaved around said sheaves of said traveling sheave and said fixed sheave assemblies, a base frame, said derrick being pivotally mounted on said base frame for movement between a collapsed position and a raised operating position, and derrick erection means operatively connected to said derrick for moving said derrick between said positions, and wherein said drive means of said traveling sheave assembly includes;

an elongated power screw rotatably mounted on said boom; and a follower threaded to said power screw, said follower being connected to said traveling sheaves.

35. A crane as defined by claim 34 further comprising:

a hoist traveling sheave assembly including a plurality of hoist sheaves and hoist drive means for moving said hoist sheaves along the longitudinal axis of said boom;

a plurality of fixed hoist sheaves mounted on said boom; and a hoist cable having an end fixed to said boom, said hoist cable being reaved around said hoist sheaves and said fixed hoist sheaves and exiting said boom along the longitudinal axis thereof.

36. A crane as defined by claim 35 wherein one of said fixed hoist sheaves defines a fixed point for said hoist cable, said one of said fixed hoist sheaves rotating only to accommodate geometric irregularities of said hoist assembly and said fixed hoist sheaves.

37. A crane as defined by claim 36 wherein one of said fixed sheaves defines a fixed point for said pitch cable, said one of said fixed sleeves rotating only to accommodate geometric irregularities of said assemblies.

38. A crane as defined by claim 37 wherein said derrick comprises an elongated tower member pivoted to said base frame and wherein said derrick erection means comprises a collar encircling said tower member; an erection slider on said base frame; a strut interconnecting said slider and said collar; and an erection drive means engaging said slider for moving said slider on said base frame to move said tower member between said positions.

39. A crane comprising:

a derrick;

an elongated boom;

pivot means on said device for pivotally mounting said boom to said derrick for movement about a pitch axis;

a traveling sheave assembly on said boom, said assembly including a plurality of sheaves and drive means for moving said sheaves along a longitudinal axis of said boom;

a fixed sheave assembly including a plurality of fixed sheaves mounted on said boom;

a pitch cable having a pair of ends attached to said derrick, said cable being reaved around said sheaves of said traveling sheave and said fixed sheave assemblies, a base frame, said derrick being pivotally mounted on said base frame for movement between a collapsed position and raised operating position, and derrick erection means operatively connected to said derrick for moving said derrick between said positions, said derrick comprising an elongated tower member pivoted to said base frame and wherein said derrick erection means comprises a collar encircling said tower member; an erection slider on said base frame; a strut interconnecting said slider and said collar; and erection drive means engaging said slider for moving said slider on said base frame to move said tower member between said positions.

40. A crane comprising:

a derrick;

an elongated boom;

pivot means on said device for pivotally mounting said boom to said derrick for movement about a pitch axis;

a traveling sheave assembly on said boom, said assembly including a plurality of sheaves and drive means for moving said sheaves along a longitudinal axis of said boom;

a fixed sheave assembly including a plurality of fixed sheaves mounted on said boom; and a pitch cable having a pair of ends attached to said derrick, said cable being reaved around said sheaves of said traveling sheave and said fixed sheave assemblies;

a hoist traveling sheave assembly including a plurality of hoist sheaves and hoist drive means for moving said hoist sheaves along the longitudinal axis of said boom;

a plurality of fixed hoist sheaves mounted on said boom; and a hoist cable having an end fixed to said boom, said hoist cable being reaved around said hoist sheaves and said fixed hoist sheaves and exiting said boom along the longitudinal axis thereof.

41. A crane as defined by claim 40 wherein one of said fixed hoist sheaves defines a fixed point for said hoist cable, said one of said fixed hoist sheaves rotating only to accommodate geometric irregularities of said hoist assembly and said fixed hoist sheaves.

42. A crane as defined by claim 40 further including:

derrick rotation means for rotating said derrick and said boom about a yaw axis.

43. A crane as defined by claim 42 further including:

a trailer, said base frame being mounted on said trailer.

44. A crane as defined by claim 43 wherein said trailer includes:

an elongated arm;

a counter weight on an end of said arm; and pivot means for rotatably mounting said counter weight on said trailer.

45. A crane comprising:

a derrick;

an elongated boom;

pivot means on said device for pivotally mounting said boom to said derrick for movement about a pitch axis;

a traveling sheave assembly on said boom, said assembly including a plurality of sheaves and drive means for moving said sheaves along a longitudinal axis of said boom;

a fixed sheave assembly including a plurality of fixed sheaves mounted on said boom; and a pitch cable having a pair of ends attached to said derrick, said cable being reaved around said sheaves of said traveling sheave and said fixed sheave assemblies, and wherein one of said fixed sheaves defines a fixed point for said pitch cable, said one of said fixed sheaves rotating only to accommodate geometric irregularities of said assemblies.

* * * * *

UNITED STATES PATENT AND TRADEMARK OFFICE

CERTIFICATE OF CORRECTION

PATENT NO. : 5,016,768

DATED : May 21, 1991

INVENTOR(S) : Dwight C. Kennard, Jr. et al.

It is certified that error appears in the above-identified patent and that said Letters Patent is hereby corrected as shown below:

Column 2, line 65;

"a end" should be --an end--.

Column 2, line 68;

After "hoist" delete --,--.

Column 4, line 40;

"arrangement 70" should be --arrangement 170--.

Column 7, line 14;

After "449" insert --.--.

Column 9, claim 8, line 59;

"and" should be --said--.

Signed and Sealed this

Twenty-seventh Day of October, 1992

*Attest:*

DOUGLAS B. COMER

*Attesting Officer*

*Acting Commissioner of Patents and Trademarks*